US005676770A

United States Patent [19]

Sato et al.

[11] Patent Number: 5,676,770

[45] Date of Patent: Oct. 14, 1997

[54] LOW LEAKAGE FLUX, NON-ORIENTED ELECTROMAGNETIC STEEL SHEET, AND CORE AND COMPACT TRANSFORMER USING THE SAME

[75] Inventors: Keiji Sato; Kouji Yano; Minoru Takashima; Masaki Kawano, all of Okayama; Takashi Obara, Chiba, all of Japan

[73] Assignee: Kawasaki Steel Corporation, Japan

[21] Appl. No.: 570,288

[22] Filed: Dec. 11, 1995

[30] Foreign Application Priority Data

Dec. 14, 1994 [JP] Japan ..... 6-310465

[51] Int. Cl.[6] ..... H01F 1/147

[52] U.S. Cl. ..... 148/307; 148/306; 420/117

[58] Field of Search ..... 148/306, 307, 148/308; 420/117

[56] References Cited

U.S. PATENT DOCUMENTS 4,204,890 5/1980 Irie et al. ..... 148/111

4,946,519 8/1990 Honda et al. ..... 148/307

FOREIGN PATENT DOCUMENTS 59-46009 3/1984 Japan ..... 148/306

*Primary Examiner*—John Sheehan

*Attorney, Agent, or Firm*—Austin R. Miller

[57] ABSTRACT

This invention relates to a non-oriented electromagnetic steel sheet with low leakage flux for a compact transformer and a method for making the same. After stress relief annealing, the magnetic permeability $\mu_C$ of the sheet in the direction transverse to the sheet rolling direction is $$\mu_C \geqq \text{about } 2.5\times10^{-3} \text{ (H/m)}$$

and magnetic permeability $\mu_D$ of the sheet in the direction 45° to the sheet rolling direction is $$\mu_D \geqq \text{about } 1.5\times10^{-3} \text{ (H/m)}.$$

5 Claims, 2 Drawing Sheets

LOW LEAKAGE FLUX, NON-ORIENTED ELECTROMAGNETIC STEEL SHEET, AND CORE AND COMPACT TRANSFORMER USING THE SAME

BACKGROUND OF THE INVENTION

1. Field of the Invention

The present invention relates to a non-oriented electromagnetic steel sheet, and in particular, a non-oriented electromagnetic steel sheet exhibiting low leakage flux when used as an iron core of a compact transformer.

2. Description of the Related Art

There are several types of transformers in common use, such as large scale transformers for electrical power, wound core transformers, compact transformers for audio devices, and stabilizers for fluorescent lamps. Grain-oriented electromagnetic steel sheets are generally utilized as iron cores for large scale transformers adapted for electricity generation or distribution, while non-oriented electromagnetic steel sheets are used as iron cores in compact transformers of audio devices and in stabilizers of fluorescent lamps.

Grain-oriented electromagnetic steel sheets have significantly better magnetic characteristics along the sheet rolling direction as compared with other directions. Through a complex manufacturing process, the rolling direction of a grain-oriented electromagnetic steel sheet is designed to correspond with the direction of magnetic flux flow of the iron core in large scale transformers.

In contrast, since low cost is an essential element of compact transformers, less complicated process and assembly means are generally employed even though magnetic flux also flows in directions other than the rolling direction. In EI cores, for example, which are commonly used in compact transformers, the magnetic flux flows in the rolling direction in two-thirds of the iron core, in the leg portion of the E-shape core and in the I-shape core. The magnetic flux flows in the transverse direction to the rolling direction in the remaining one-third of the iron core and in the back portion of the E-shape core.

In electromagnetic sheets suitable for compact transformers, magnetic flux flows in the rolling direction in approximately two-thirds the iron core, while in the remaining one-third the magnetic flux flows in the transverse direction to the rolling direction. Thus, materials having excellent magnetic characteristics in the rolling direction are suitable materials for electromagnetic sheets of compact transformers.

A method for producing an electromagnetic steel sheet suitable as an iron core material of compact transformers is disclosed, for example, in Japanese Patent Laid-Open No. 61-119618. The method attempts to significantly increase the anisotropy of the electromagnetic steel sheet by employing two cold rolling steps with an intermediate annealing, wherein the temperature of the intermediate annealing is controlled to between 675° and 750° C., and the rolling reduction of the second cold rolling is controlled to between 3 and 7%.

Using materials having such high anisotropy in compact transformers improves iron loss. However, leakage flux, another important characteristic of an EI-shape iron core, does not always decrease. Leakage flux causes a beat note or an acoustic noise in the iron core, thereby creating a serious problem when the transformers are used in audio devices.

SUMMARY OF THE INVENTION

An object of the invention is to provide a non-oriented electromagnetic steel sheet having low leakage flux when used in a compact transformer designed to generate magnetic flux in a direction other than the rolling direction of the steel sheet.

It is an object of the present invention to provide a non-oriented electromagnetic steel sheet which exhibits low leakage flux when used as a compact transformer. We have intensively studied the relationship between leakage flux and material characteristics of compact transformers. As a result, we discovered that magnetic permeability $\mu_C$ in the direction transverse to the rolling direction as well as magnetic permeability $\mu_D$ in the direction at 45° to the rolling direction closely correlate to the leakage flux of the transformers. The present invention is based on this discovery.

It is a further object of the present invention to provide an iron core for a compact transformer comprising non-oriented electromagnetic steel sheets having these advantages.

It is still another object of the present invention to provide a compact transformer having an iron core which comprises non-oriented electromagnetic steel sheets having these advantages.

DETAILED DESCRIPTION OF THE PREFERRED EMBODIMENTS

Figure 1A:
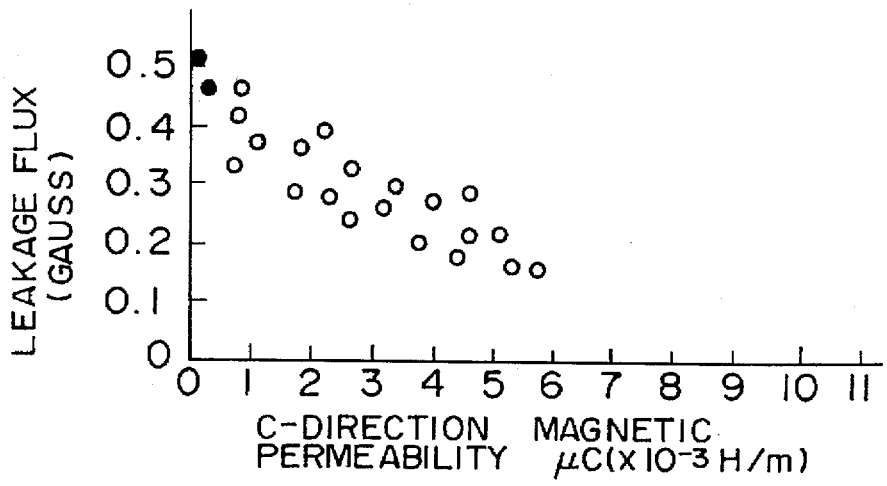
FIG. 1A is a graph showing the relationship between the magnetic permeability $\mu_C$ of a non-oriented electromagnetic steel sheet in the C direction and the leakage flux of an EI-shape iron core formed from the sheet.

In this invention we have created an electromagnetic steel sheet which has highly beneficial directional permeability values after straightening annealing, comprising a magnetic permeability $\mu_C$ in the direction transverse to the rolling direction of $\mu_C \geqq$ about $2.5\times10^{-3}$ (H/m), and a magnetic permeability $\mu_D$ in the direction at 45° to the rolling direction of $\mu_D \geqq$ about $1.5\times10^{-3}$ (H/m).

The present invention will now be explained in detail. First, the experimental results which led to the discovery of this invention will be explained.

A steel slab containing 0.0048 weight percent of C, 0.55 weight percent of Si, 0.47 weight percent of Mn, and the balance Fe and incidental impurities was hot-rolled to 2 mm thick plate. After pickling, the hot-rolled plate was cold-rolled to an intermediate thickness of 0.50 to 0.56 mm, after which an intermediate annealing was performed at 800° C. for 2 minutes in an hydrogen/nitrogen mixed atmosphere. The plate was finished to a 0.50 mm thick cold-rolled sheet by skin-pass rolling while controlling the rolling reduction. At positions where the plate had reached an intermediate thickness of 0.50 mm after cold-rolling, a skin-pass rolling was not performed. Sheet materials having various aggregate textures were obtained by changing the skin-pass rolling conditions within the rolling speed range of 20 to 2,000 m/min and the rolling tension range of 0.1 to 0.5 kg/cm$^2$.

Each of the resulting cold-rolled sheets was cut to Epstein samples (30 mm wide by 280 mm long) in the rolling direction (expressed as L direction below), the transverse (normal) direction to the rolling direction (expressed as C direction below) and in the direction 45° to the rolling direction (expressed as D direction below). After straightening annealing for one hour, the samples were evaluated for core loss, magnetic flux density, and magnetic permeability in the L, C and D directions.

EI-shape iron cores were then formed from these materials. The I-shape portion in each iron core was 11 mm wide by 66 mm long in accordance with the standard EI66 in JISC2514. The iron cores were produced by stamping 20 E-shape and 20 I-shape test pieces from each material. After stress relief annealing at 725° C. for one hour in a hydrogen/nitrogen mixed atmosphere, the E-shape test pieces were stacked in the same direction, as were the I-shape test pieces. After first and second windings were inserted in the central leg portion of the stacked E-shape test pieces, the stacked E-shape and I-shape test pieces were welded to each other.

The leakage flux of the resulting EI-shape iron core was evaluated by measuring leakage flux in the direction toward the iron core center at positions spaced from the iron core center with a Gauss meter. An averaged value of twelve measuring points around the iron core was calculated.

Figure 1B:
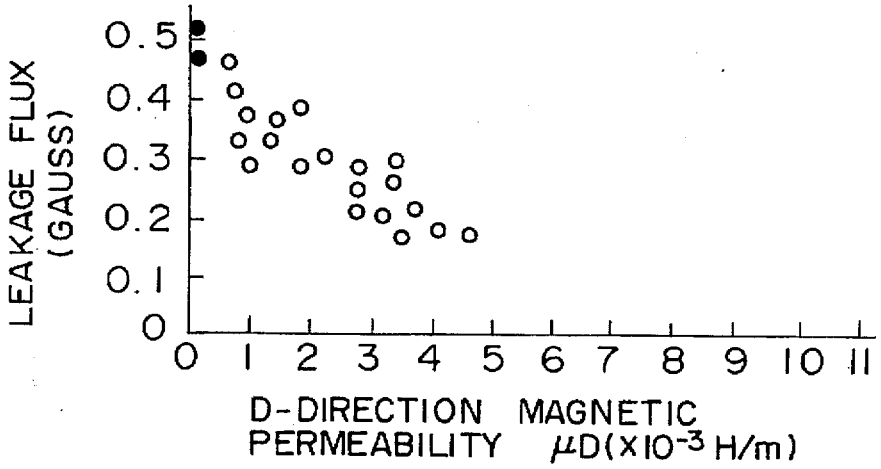
FIG. 1B is a graph showing the relationship between the magnetic permeability $\mu_D$ of a non-oriented electromagnetic steel sheet in the D direction and the leakage flux of an EI-shape iron core formed from the sheet.

A relationship between leakage flux of the EI-shape iron cores and the magnetic characteristics of the sheets comprising the cores was discovered. As shown in FIGS. 1A and 1B, the leakage flux of the EI-shape iron cores correlates closely with the C direction magnetic permeability $\mu_C$ and D direction magnetic permeability $\mu_D$. Unlike the correlations with $\mu_C$ and $\mu_D$, no distinct correlation is found between the leakage flux of the EI-shape iron cores and the L direction magnetic permeability $\mu_L$, as shown in FIG. 1C.

Figure 1C:
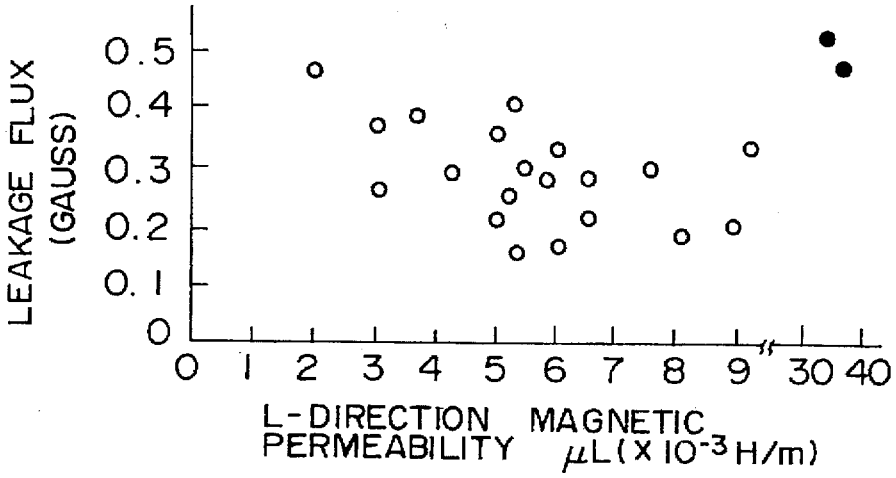
FIG. 1C is a graph showing the relationship between the magnetic permeability $\mu_L$ of a non-oriented electromagnetic steel sheet in the L direction and the leakage flux of an EI-shape iron core formed from the sheet.

As a reference, FIGS. 1A–1C also show the results (denoted as black circles) of evaluations of EI-shape iron cores formed from a grain-oriented electromagnetic steel sheet 0.35 mm thick. As revealed in FIGS. 1A and 1B, the leakage flux of the EI-shape iron cores formed from the grain-oriented electromagnetic steel sheet is higher than that of those cores formed from the non-oriented electromagnetic steel sheet, thereby confirming the strong correlation between leakage flux and the $\mu_C$ or $\mu_D$ of the material.

Figure 2:
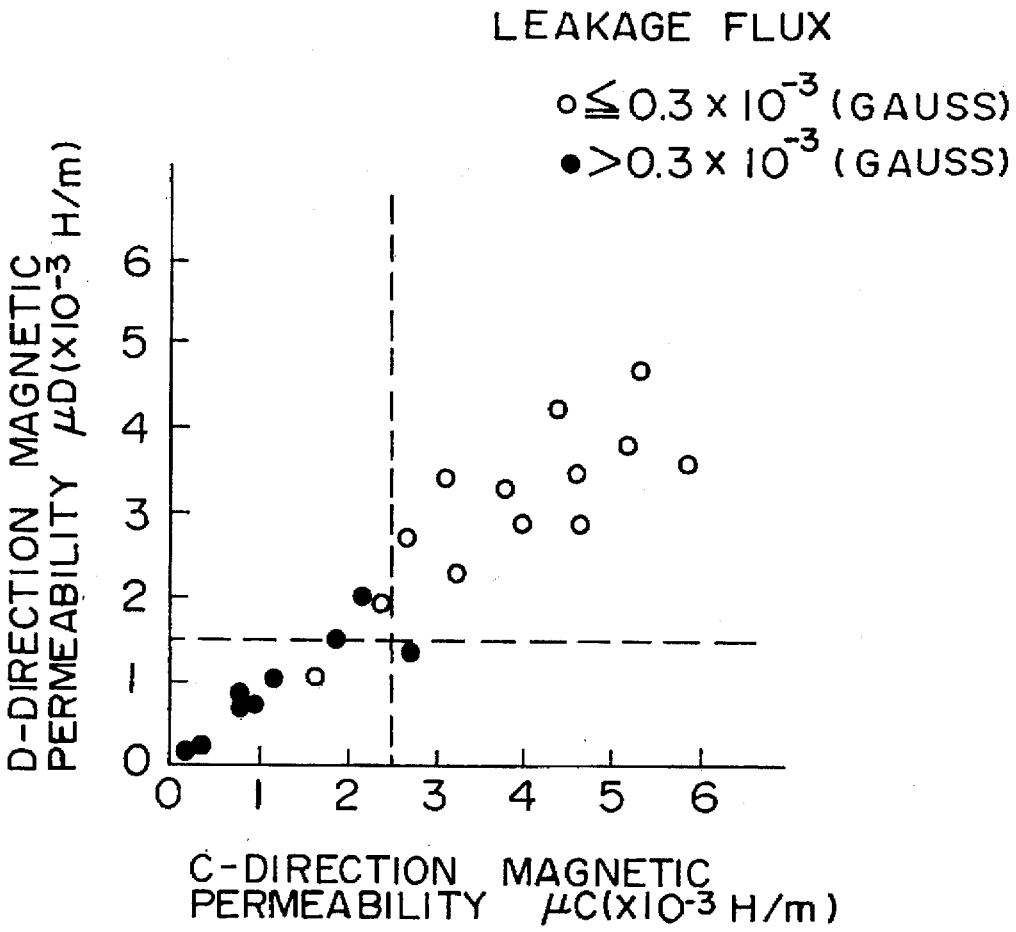
FIG. 2 is a graph showing the relationship between the magnetic permeability $\mu_C$ of a non-oriented electromagnetic steel sheet in the C direction and the magnetic permeability $\mu_D$ of the sheet in the D direction, and the leakage flux of an EI-shape iron core formed from the sheet.

Further studies revealed that leakage flux is extremely low (about 0.3 gauss) when the magnetic permeability $\mu_C$ of the material is about $2.5\times10^{-3}$ (H/m) or more and the magnetic permeability $\mu_D$ of the material is about $1.5\times10^{-3}$ (H/m) or more, as shown in FIG. 2. Inspiration for the present invention was derived from these findings.

The high correlation between the leakage flux and the magnetic permeabilities $\mu_C$ and $\mu_D$ may be due to the predominant wraparound of magnetic flux at the back and corner of the E-shape iron core, i.e. the portion of the core in which the magnetic flux flows in the 90° or 45° direction to the rolling direction of the material.

Ranges for elemental components of the steel sheet of the present invention will now be explained.

C: About 0.020 Weight Percent or Less

Since C degrades magnetic characteristics, it is preferred that C content be as low as possible. However, a content not exceeding about 0.020 weight percent is allowable in the present invention.

Si: About 0.1 to 1.0 Weight Percent

Since Si is an useful component for increasing electrical resistance and decreasing core loss, it is included at about 0.1 wt % or more. However, a content exceeding about 1.0 wt % not only lowers saturated magnetic flux density, but also decreases $\mu_C$. Thus, Si content is limited to about 0.1 to 1.0 weight percent.

Mn: About 0.1 to 1.0 Weight Percent

Mn improves hot shortness when it comprises about 0.1 wt % or more of the steel sheet. On the other hand, a content exceeding about 1.0 wt % degrades magnetic characteristics. Thus, Mn content is controlled to about 0.1 to 1.0 wt %.

In the present invention, at least one component selected from the group consisting of Al, P, Sb and Sn may be added to the above-described components in the following contents.

Ai: About 1.0 wt % or Less

Al increases specific resistance and decreases eddy- current loss. Since a content over about 1.0 wt % lowers magnetic flux density, the content is preferably about 1.0 wt % or less.

P: About 0.08 wt % or Less

Like Al, P is a useful component for increasing specific resistance and decreasing eddy-current loss. However, a content exceeding about 0.08 wt % deteriorates formability. Thus, it is preferable that the P content in the steel sheet not exceed about 0.08 wt %.

Sb: About 0.08 wt % or Less

Sb efficiently improves the aggregate texture of the steel sheet. A content exceeding about 0.08 wt %, however, inhibits crystal grain growth. Thus, it is preferable that Sb content not exceed about 0.08 wt %.

Sn: About 0.2 wt % or Less

Like Sb, Sn improves the aggregate texture of the steel sheet. Since a content exceeding about 0.2 wt % also inhibits crystal grain growth, it is preferable that Sn content not exceed about 0.2 wt %.

In addition to the above-specified composition, it is essential that, after stress relief annealing, the non-oriented electromagnetic steel sheet of the present invention exhibits a magnetic permeability $\mu_C \geqq$ about $2.5\times10^{-3}$ (H/m) in the direction transverse to the sheet rolling direction and a magnetic permeability $\mu_D \geqq$ about $1.5\times10^{-3}$ (H/m) in the direction at 45° to the sheet rolling direction.

To decrease the leakage flux of the transformer, both the $\mu_C$ and $\mu_D$ must satisfy the above conditions. If either $\mu_C$ or $\mu_D$ is below these specified values, leakage flux will not decrease adequately. Lowering leakage flux by requiring that the magnetic permeabilities $\mu_C$ and $\mu_D$ exceed predetermined values is unknown in the prior art of non-oriented electromagnetic steel sheets.

The method of producing the non-oriented electromagnetic steel sheet of the present invention is not particularly limited. The following method is presented as an illustrative example of one manner in which the invention may be made. A melted steel of a predetermined composition is formed into a slab by continuous casting or ingot blooming. After heating, the slab is hot-rolled, followed by a hot-rolling annealing as needed. After the plate is washed with acid, a first cold-rolling, an intermediate annealing, and a second cold-rolling finish the plate to a final sheet thickness. In this method, it is essential that the second cold-rolling is carried out by skin-pass rolling at a rolling reduction of about 5 to 10%, and the rolling speed and tension at the rolling step are controlled to about 1,000 to 2,000 m/min and about 0.1 to 0.5 kg/cm$^2$, respectively, in order to obtain a steel sheet possessing the $\mu_C$ and $\mu_D$ values of the present invention.

Either a semi-process or a full process is applicable for the non-oriented electromagnetic steel sheet of the present invention. To lower production costs, stress relief annealing after the cold-rolling is preferably performed at low temperatures for short annealing times. Typically, annealing has been carried out at about 750° C. for about 2 hours. However, annealing is now often carried out at about 725° C. for about 1 hour. Therefore, the above-described cold-rolling conditions should be maintained even when annealing is performed at about 725° C. for about 1 hour.

The invention will now be described through illustrative examples. The examples are not intended to limit the scope of the invention defined in the appended claims.

about 0 1 to 0.5 kg/cm$^2$ respectively. As a result, the leakage flux $B_L$ of the EI core in accordance with the invention was less than 0.30 gauss.

As described above, the non-oriented electromagnetic steel sheet according to the present invention exhibits a greatly reduced leakage flux as compared with conventional steel sheets used as iron cores of compact transformers. Further, iron cores for compact transformers and the compact transformers themselves, in accordance with the present invention, possess excellent magnetic characteristics because of the non-oriented electromagnetic steel sheets from which they are made.

Although this invention has been described in connection with specific forms thereof, it will be appreciated that a wide variety of equivalents may be substituted for the specific elements described herein without departing from the spirit and scope of the invention defined in the appended claims.

TABLE 1

| | Skin Pass Conditions | | | Magnetic Permeability of Material $\mu_{15/50}$(× 10$^{-3}$ H/m) | | | Leakage Flux $B_{L\ 15/50}$ | |
|---|---|---|---|---|---|---|---|---|
| Samples | Rolling Reduction (%) | Rolling Speed (m/min) | Rolling Tension (kg/cm$_2$) | $\mu_L$ | $\mu_C$ | $\mu_D$ | (gauss) | Remarks |
| 1 | 8 | 1200 | 0.2 | 8.8 | 4.2 | 3.2 | 0.20 | Example of Invention |
| 2 | 9 | 1500 | 0.3 | 8.0 | 4.9 | 4.1 | 0.18 | Example of Invention |
| 3 | 7 | 1100 | 0.5 | 6.5 | 4.0 | 2.8 | 0.21 | Example of Invention |
| 4 | 6 | 1600 | 0.4 | 5.2 | 3.5 | 2.8 | 0.25 | Example of Invention |
| 5 | 8 | 1900 | 0.5 | 4.3 | 2.9 | 1.8 | 0.29 | Example of Invention |
| 6 | 2 | 1500 | 0.05 | 9.2 | 3.2 | 0.8 | 0.33 | Comparative Example |
| 7 | 7 | 700 | 0.7 | 3.7 | 2.3 | 1.8 | 0.39 | Comparative Example |
| 8 | 15 | 2500 | 0.3 | 2.0 | 1.1 | 0.6 | 0.47 | Comparative Example |
| 9 | 8 | 1200 | 0.05 | 6.5 | 2.2 | 1.4 | 0.42 | Comparative Example |
| 10 | 8 | 1200 | 0.7 | 8.3 | 1.8 | 0.9 | 0.44 | Comparative Example |

A steel slab containing 0.0038 wt % of C, 0.58 wt % of Si, 0.32 wt % of Mn, 0.45 wt % of Al, 0.050 wt % of Sb, 0.005 wt % of P, and 0.1 wt % of Sn was hot-rolled and washed with an acid. Thereafter, the plate was finished to a sheet product having a final thickness by two cold-rolling steps with an intermediate annealing performed between the cold rollings. The second cold-rolling embodied a skin pass rolling performed under various conditions within the following ranges: a rolling reduction of 2 to 15%, a rolling speed of 700 to 2,500 m/min, and a rolling tension of 0.05 to 0.7 kg/cm$^2$. E- and I-shape test pieces having a magnetic core size of 66 mm were punched from these materials. After stress relief annealing for 1 hour, the test pieces were stacked and welded to evaluate their magnetic characteristics.

Epstein samples of the L, C, and D directions were produced from the same steel sheet described above and were used to evaluate the material characteristics after annealing at 725° C. for 1 hour. Table 1 shows the correlation between the leakage flux of the EI core and the magnetic permeability of the material. The method used to measure leakage flux is the same as that used for FIG. 1.

Table 1 reveals that magnetic permeability $\mu_C$ is at least about 2.5×10$^{-3}$ (H/m) in the direction transverse to the rolling direction and magnetic permeability $\mu_D$ is at least about 1.5×10$^{-3}$ (H/m) in the direction at 45° to the rolling direction when skin-pass rolling is used such that the rolling reduction, rolling speed, and rolling tension are controlled in the ranges of about 5 to 10%, about 1,000 to 2,000 mpm, and

What is claimed is:

1. A non-oriented electromagnetic steel sheet exhibiting low leakage flux and capable of being used in a compact transformer, said sheet having a rolling direction and a composition including about 0.020 weight percent or less of C, about 0.1 to 1.0 weight percent of Si, about 0.1 to 1.0 weight percent of Mn, and the balance Fe and incidental impurities, said electromagnetic steel sheet having been straightening annealed and having directional permeability values comprising:

(a) magnetic permeability $\mu_C$ in a direction normal to said rolling direction in the amount of $\mu_C \geqq$ about 2.5×10$^{-3}$ (H/m), and (b) magnetic permeability $\mu_D$ in a direction 45° to said rolling direction in the amount of $\mu_D \geqq$ about 1.5×10$^{-3}$ (H/m).

2. A non-oriented electromagnetic steel sheet according to claim 1, wherein said electromagnetic steel sheet further contains at least one element selected from the group consisting of about 1.0 weight percent or less of Al, about 0.08 weight percent or less of P, about 0.08 weight percent or less of Sb, and about 0.2 weight percent or less of Sn.

3. An iron core capable of being used in a compact transformer, said iron core comprising the non-oriented electromagnetic steel sheet defined in claim 1 or claim 2.

4. A compact transformer comprising the iron core defined in claim 3.

5. A non-oriented electromagnetic steel sheet manufactured by preparing a slab of composition defined in claim 1 or claim 2, hot rolling said slab to form a hot-rolled plate, washing said hot-rolled plate with acid to form a washed plate, and finishing said washed plate to form said non-oriented electromagnetic steel sheet;

said finishing comprising:

(a) performing a first cold roiling on said washed plate to form a cold-rolled sheet, (b) intermediate annealing said cold-rolled sheet to form an annealed cold-rolled sheet, and (c) performing a second cold rolling on said annealed cold-rolled sheet to form said non-oriented electromagnetic steel sheet, said second cold roiling comprising a skin-pass rolling performed at a rolling reduction of about 5 to 10%, a rolling speed of about 1,000 to 2,000 m/min, and a rolling tension of about 0.1 to 0.5 $kg/cm^2$.

* * * * *